US009462923B2

(12) United States Patent
Powell

(10) Patent No.: US 9,462,923 B2
(45) Date of Patent: Oct. 11, 2016

(54) APPARATUS FOR CLEANING BASEBOARDS

(71) Applicant: Andrew J. Powell, N. Myrtle Beach, SC (US)

(72) Inventor: Andrew J. Powell, N. Myrtle Beach, SC (US)

( * ) Notice: Subject to any disclaimer, the term of this patent is extended or adjusted under 35 U.S.C. 154(b) by 0 days.

(21) Appl. No.: 14/484,004

(22) Filed: Sep. 11, 2014

(65) Prior Publication Data

US 2016/0073847 A1 Mar. 17, 2016

(51) Int. Cl.

| | |
|---|---|
| ***A46B 11/00*** | (2006.01) |
| ***A47L 13/44*** | (2006.01) |
| ***A47L 13/258*** | (2006.01) |

(52) U.S. Cl.

CPC ..... *A47L 13/44* (2013.01); *A47L 13/258* (2013.01)

(58) Field of Classification Search

CPC ..... A46B 11/00; A46B 17/02; A47L 13/16; A47L 13/44; A47L 11/38

See application file for complete search history.

(56) References Cited

U.S. PATENT DOCUMENTS

| | | | | |
|---|---|---|---|---|
| 2,989,763 | A | 6/1961 | Bradley | |
| 3,533,120 | A | 10/1970 | De Mercado | |
| 4,024,597 | A | 5/1977 | Fouracre | |
| 4,299,004 | A | 11/1981 | Lancaster | |
| 4,691,403 | A | 9/1987 | Scharf | |
| 4,783,872 | A | 11/1988 | Burhoe | |
| 5,261,139 | A | 11/1993 | Lewis | |
| 5,371,912 | A | 12/1994 | Hall | |
| 5,432,970 | A * | 7/1995 | Reid | A47L 11/162 15/246 |
| 5,533,222 | A * | 7/1996 | Lelkes | A46B 13/003 15/230 |
| 2004/0187238 | A1 | 9/2004 | Young | |
| 2006/0182487 | A1 | 8/2006 | Sandoval | |

* cited by examiner

*Primary Examiner* — Shay Karls

(74) *Attorney, Agent, or Firm* — P. Jeff Martin; The Law Firm of P. Jeffrey Martin, LLC

(57) ABSTRACT

An apparatus for cleaning baseboards includes a cleaning head having a bi-directionally adjustable handle coupled thereto via a pivot assembly. The cleaning head includes a plurality of plates between which a plurality of pads is secured in stacked fashion.

14 Claims, 16 Drawing Sheets

APPARATUS FOR CLEANING BASEBOARDS

I. RELATED APPLICATIONS

There are no previously filed, nor currently any co-pending applications, anywhere in the world.

II. FIELD OF THE INVENTION

This application discloses claims and embodiments generally related to devices for cleaning and dusting floors, and more particularly, to an apparatus for cleaning baseboards having a cleaning head which includes a plurality of stacked cleaning pads, and a bi-directionally adjustable handle coupled to the cleaning head.

III. BACKGROUND OF THE INVENTION

A baseboard is defined as a wooden trim or other material that is positioned flush to the base of a wall and the floor surface. Baseboards are also known as floor molding and floor trim. Baseboards typically have a top edge, vertical and/or curves, grooves, and additional trim such as quarter round, shoe molding, or similar small trim. Cleaning all these baseboard areas is difficult by hand and often requires the person to be on their hands and knees on the floor.

Pushing foam or sponges into the wall also requires a great deal of effort and is tiring. Brooms and mop cleaning devices are an alternative but are also inferior because they are not designed to access edges and with repeated cleanings they eventually damage the painted or wallpapered surfaces of the wall. Whichever cleaning method is selected, the surface area to be cleaned requires many repeated cleaning swipes to fully access the baseboard fillets since it's difficult to access the edges, recesses, and grooves simultaneously and protect the floor, baseboard, and wall finishes.

Baseboards can also be difficult to access when located behind headboards, in laundry rooms, or behind large furniture.

The inventor of the present invention has an engineering background and has put an enormous amount of design, prototyping, and testing that addresses the negative aspects concerning prior art and current baseboard cleaning methods and devices.

A search of the prior art did not disclose any patents that read directly on the claims of the instant invention; however, the following references were considered related:

U.S. Pat. No. 4,024,597, issued in the name of Fouracre;

U.S. Patent Application no. 2006/0182487 A1, published in the name of Sandoval;

U.S. Pat. No. 5,371,912, issued in the name of Hall;

U.S. Pat. No. 5,261,139, issued in the name of Lewis;

U.S. Pat. No. 4,299,004, issued in the name of Lancaster;

U.S. Pat. No. 2,989,763, issued in the name of Bradley;

U.S. Patent Application no. 2004/0187238 A1, published in the name of Young;

U.S. Pat. No. 3,533,120, issued in the name of De Mercado;

U.S. Pat. No. 4,783,872, issued in the name of Burhoe; and

U.S. Pat. No. 4,691,403, issued in the name of Scharf.

This application presents claims and embodiments that fulfill a need or needs not yet satisfied by the products, inventions and methods previously or presently available. In particular, the claims and embodiments disclosed herein describe an apparatus for cleaning baseboards, the apparatus comprising: a cleaning head comprising an upper section and a lower section; a bi-directionally adjustable handle; and a plurality of pads coupled to the cleaning head in a stacked fashion, the apparatus of the present invention providing unanticipated and nonobvious combination of features distinguished from the products, devices, apparatuses, inventions and methods preexisting in the art. The applicant is unaware of any product, device, method, disclosure or reference that discloses the features of the claims and embodiments disclosed herein, and as more fully described below.

IV. SUMMARY OF THE INVENTION

An apparatus for cleaning baseboards is disclosed. The apparatus is adapted and configured to allow baseboards and floor trimming to be cleaned by the user of the apparatus while standing, or otherwise in a generally upright position without the use of harsh chemicals, solutions, or other mixtures and without causing damage to the baseboards and floor trimming, in a quick, easy, and efficient manner.

The apparatus comprises a cleaning head which includes an upper section and a lower section. The apparatus further comprises a bi-directionally adjustable handle coupled to the cleaning head via a pivot assembly. The pivot assembly is pivotally coupled to the cleaning head via a fastener.

The cleaning head further includes a plurality of pads coupled thereto. The plurality of pads are adapted and configured to flexibly conform to the outer surface shape and contour of baseboards, including shoe molding and any other floor molding and floor trimming. The pads are further coupled to the cleaning head in such as manner so as to freely translate vertically during a baseboard cleaning operation.

The upper section of cleaning head comprises an upper support and a lower support. The upper support comprises a first planar plate, and the upper support comprises a second planar plate. The lower section comprises a base plate.

The plurality of pads comprises a first set of pads and a second set of pads. Each pad of the first and second set of pads comprises a planar configuration. The first set of pads is secured via a fastener in stacked fashion and mirrored alignment between the first planar plate of upper support and the second planar plate of lower support. The second set of pads is secured in stacked fashion and mirrored alignment between the second planar plate of lower support and the base plate of the lower section.

The handle is coupled to the cleaning head via a bi-directional pivot assembly. A lower end of the handle comprises a stem for engaging the bi-directional pivot assembly in a detachably secured manner. In accordance to one embodiment, the handle may comprise a single elongated cylinder or member. In accordance to another embodiment, the handle is telescopically adjustable so as to allow for a plurality of selectively-desired, longitudinal setting positions thereof.

V. BRIEF DESCRIPTION OF THE DRAWING(S)

The advantages and features of the present invention will become better understood with reference to the following more detailed description and claims taken in conjunction with the accompanying drawings, in which like elements are identified with like symbols, and in which:

VI. DETAILED DESCRIPTION OF THE EMBODIMENT(S)

Figure 1:
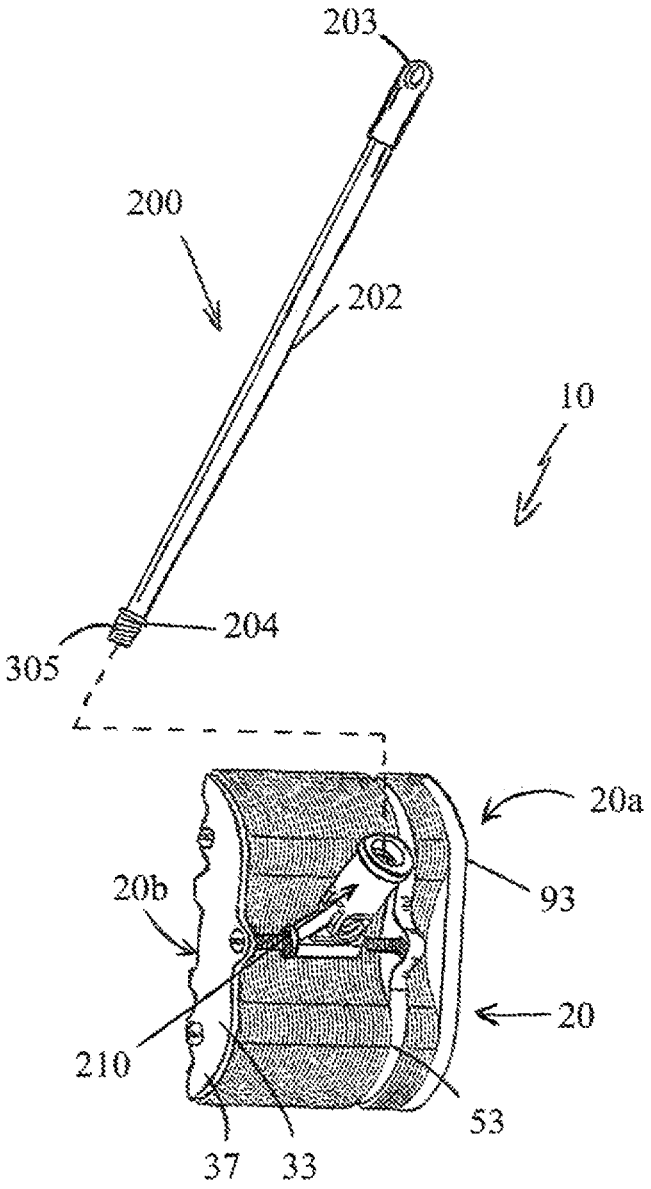
FIG. 1 is an exploded perspective view of an apparatus for cleaning baseboards, in accordance to one embodiment of the present invention.

It will be readily understood that the components of the present invention, as generally described and illustrated in the figures herein, may be arranged and designed in a wide variety of different configurations. Thus, the following detailed description of the embodiments of an apparatus for cleaning baseboards, as represented in the attached figures, is not intended to limit the scope of the invention as claimed, but is merely representative of selected embodiments of the invention.

The features, structures, or characteristics of the invention described throughout this specification may be combined in any suitable manner in one or more embodiments. For example, the usage of the phrases "example embodiments", "some embodiments", or other similar language, throughout this specification refers to the fact that a particular feature, structure, or characteristic described in connection with the embodiment may be included in at least one embodiment of the present invention. Thus, appearances of the phrases "example embodiments", "in some embodiments", "in other embodiments", or other similar language, throughout this specification do not necessarily all refer to the same group of embodiments, and the described features, structures, or characteristics may be combined in any suitable manner in one or more embodiments.

Referring now to FIGS. 1, 3, 6 and 10, an apparatus for cleaning baseboards, generally designated at 10 is disclosed, in accordance to one embodiment of the present invention. The apparatus for cleaning baseboards 10, hereinafter "apparatus 10", is adapted and configured to allow baseboards 5 and floor trimming to be cleaned by the user of the apparatus 10 while standing, or otherwise in a generally upright position without the use of harsh chemicals, solutions, or other mixtures and without causing damage to the baseboards 5 and floor trimming, in a quick, easy, and efficient manner. The apparatus may be broadly described as comprising a cleaning head 20 having a top 20*a* and a bottom 20*b*. The apparatus 10, more specifically, comprises a cleaning head 20 which includes an upper section 30 and a lower section 90. The apparatus 10 further comprises a bi-directionally adjustable handle 200 coupled to the cleaning head 20. The cleaning head 20 comprises a plurality of pads 60, wherein the plurality of pads 60 comprises a first set of pads 60*a* and a second set of pads 60*b*. The plurality of pads 60 are adapted and configured to flexibly conform to the outer surface shape and contour of baseboards 5, including shoe molding 5*a* and any other floor molding and floor trimming.

Figure 3:
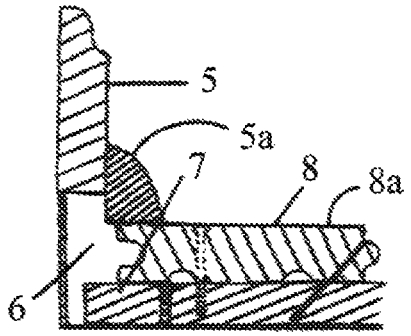
FIG. 3 is a partial cross-sectional view of a flooring structure.
Figure 2:
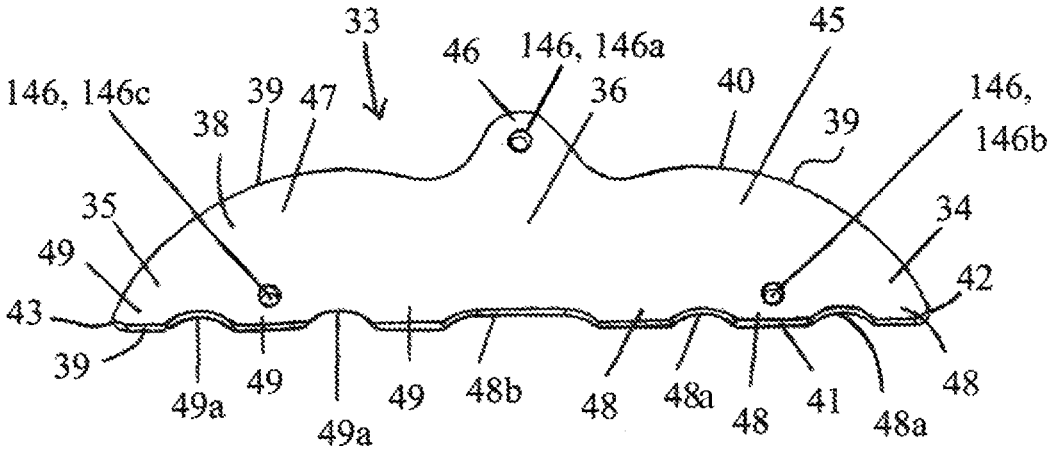
FIG. 2 is a rear perspective view of one plate of a cleaning head of an apparatus for cleaning baseboards, in accordance to one embodiment of the present invention.

Generally, flooring, and particularly hardwood flooring is constructed and assembled utilizing a number of components. As illustrated in FIG. 3, these components include, but are not limited to a subfloor 7 which supports the floor 8 or flooring thereatop, expansion elements 6 (which may be a void, gap, or a flexible joint), baseboards 5, and shoe molding 5*a* which is secured between the baseboard 5, expansion element 6 and floor 8.

Referring now more specifically to FIGS. 2, and 4-6, the upper section 30 comprises an upper support 32 and a lower support 50. The upper support 32 comprises a planar plate 33 and the lower support 50 comprises a planar plate 53. The planar plate 33 of upper support 32 and the planar plate 53 of lower support 50 each forms a number of structural, functional features that form important elements of the present invention. For example, the use of sponges, brooms, mop cleaning devices, and other baseboard cleaning is a widespread practice for cleaning baseboards 5. However, baseboards 5 typically include various ornamental designs adorned with a variety of contours and shapes. Consequently, while the prior art devices are an alternative to cleaning baseboards 5, they but also significantly inferior because they are not specifically designed to access edges, recesses, and contours of baseboards 5, and require time-intensive, physically-demanding effort to use. Accordingly, the planar plate 33 of upper support 32 and the planar plate 53 of lower support 50 are adapted to secure a plurality of pads 60 (to be described later in greater detail) therebetween in stacked fashion via a fastening means, wherein the fastening means allows the pads 60 to vertically translate independently and snugly engage the contours of a baseboard 5 during a cleaning operation.

The planar plate 33 may be constructed of a rigid or semi-rigid material, such as plastic or cellular polymer. The planar plate 33 may also be constructed of a lightweight, rigid material which may be selected from the group which includes, but is not limited to wood, plastic, thermoplastic, metal or a metallic-plastic composite. Preferred plastic and thermoplastic materials include, but are not limited to, polystyrene, polyvinyl chloride (PVC), polypropylene, polyolefin, acrylonitrile-butadiene-styrene (ABS), polyethylene, polyurethane, polycarbonate, or blends thereof, and ABS/Nylon blend.

The planar plate 33 comprises an anterior region 34, a posterior region 35, and a central region 36 oriented therebetween. The planar plate 33 further comprises a front surface 37 opposing a rear surface 38, and a continuous peripheral edge 39 integrally joining the front surface 37 and rear surface 38, the continuous peripheral edge 39 is oriented perpendicular to the front and rear surfaces 37 and 38. The continuous peripheral edge 39 defines a top surface 40 opposing a bottom surface 41. The planar plate 33 further includes a first outer corner 42 and a second outer corner 43. The first outer corner 42 is defined as the intersection of the top surface 40 and the bottom surface 41 about the anterior region 34. The second outer corner 43 is defined as the intersection of the top surface 40 and the bottom surface 41 about the posterior region 35.

The planar plate 33 comprises a shape defining the continuous peripheral edge 39 extending upward from the first outer corner 42 into a first arcuate section 45, the first arcuate section 45 terminates into an upwardly projecting curved ear 46 or arch. The ear 46 extends into a second arcuate section 47, the second arcuate section 47 terminating at the second outer corner 43.

The bottom surface 41 of planar plate 33 includes a first series of lateral, downwardly extending flanges 48, the flanges 48 being integrally interposed by at least two upwardly oriented, spaced semi-circular recesses 48*a*. The bottom surface further includes a second series of lateral, downwardly extending flanges 49, the second series of flanges 49 being integrally interposed by at least two upwardly oriented, spaced semi-circular recesses 49*a*. The first and second series of lateral, downwardly extending flanges 48 and 49 are integrally joined by a laterally-elongated recess 48*b* interposed therebetween.

The planar plate 33 further comprises a plurality of perpendicularly-oriented holes 146 defined therethrough for receiving a fastener 170, such as a threaded bolt 172. The plurality of perpendicularly-oriented holes 146 comprises a first hole 146*a* defined through the ear 46 of planar plate 33, a second hole 146*b* defined through the anterior region 34, adjacent the bottom surface 41, and a third hole 146*c* defined through the posterior region 35, adjacent the bottom surface 41.

The lower support 50 comprises a planar plate 53, wherein the planar plate 53 may be constructed of a rigid or semi-rigid material, such as plastic or cellular polymer. The planar plate 53 may also be constructed of a lightweight, rigid material which may be selected from the group which includes, but is not limited to wood, plastic, thermoplastic, metal or a metallic-plastic composite. Preferred plastic and thermoplastic materials include, but are not limited to, polystyrene, polyvinyl chloride (PVC), polypropylene, polyolefin, acrylonitrile-butadiene-styrene (ABS), polyethylene, polyurethane, polycarbonate, or blends thereof, and ABS/Nylon blend.

The planar plate 53 comprises an anterior region 54, a posterior region 55, and a central region 56 oriented therebetween. The planar plate 53 further comprises a front surface 57 opposing a rear surface 58, and a continuous peripheral edge 59 integrally joining the front surface 57 and rear surface 58, the continuous peripheral edge 59 is oriented perpendicular to the front and rear surfaces 57 and 58. The continuous peripheral edge 59 defines a top surface 150 opposing a bottom surface 151. The planar plate 53 further includes a first outer corner 152 and a second outer corner 153. The first outer corner 152 is defined as the intersection of the top surface 150 and the bottom surface 151 about the anterior region 54. The second outer corner 153 is defined as the intersection of the top surface 150 and the bottom surface 151 about the posterior region 55.

The planar plate 53 comprises a shape defining the continuous peripheral edge 59 extending upward from the first outer corner 152 into a first arcuate section 157, the first arcuate section 157 terminates into an upwardly projecting curved ear 156 or arch. The ear 156 extends into a second arcuate section 158, the second arcuate section 158 terminating at the second outer corner 153.

The bottom surface 151 of planar plate 53 includes a first series of lateral, downwardly extending flanges 160, the flanges 160 being integrally interposed by at least two upwardly oriented, spaced semi-circular recesses 161. The bottom surface 151 further includes a second series of lateral, downwardly extending flanges 162, the second series of flanges 162 being integrally interposed by at least two upwardly oriented, spaced semi-circular recesses 163. The first and second series of lateral, downwardly extending flanges 160 and 162 are integrally joined by a laterally-elongated recess 164 interposed therebetween.

The planar plate 53 further comprises a plurality of perpendicularly-oriented bores 159 and a plurality of threaded inserts 190. The plurality of perpendicularly-oriented bores 159 is defined as recessed cavities formed therein along the front surface 57 and rear surface 58 thereof, wherein each the plurality of bores 159 for respectively receiving a threaded insert 190 of the plurality of threaded inserts 190, the threaded inserts 190 being seated in and securably affixed in the bores 159, respectively.

Figure 7:
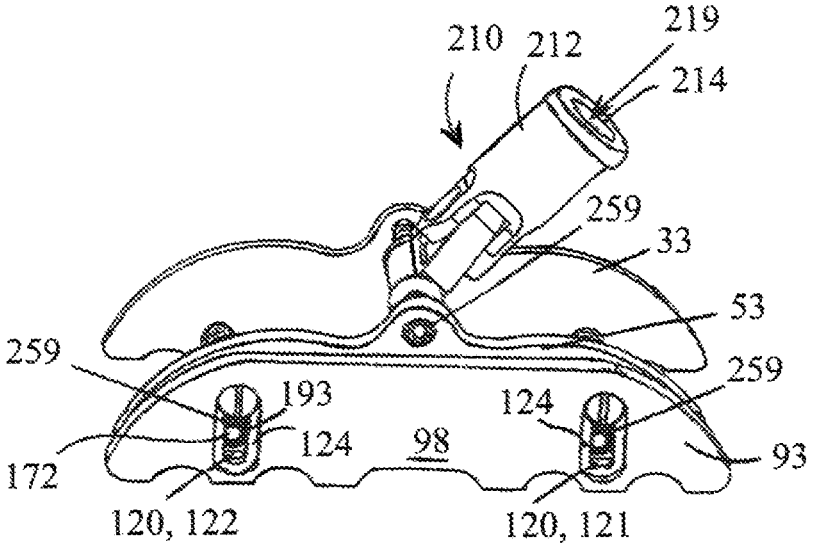
FIG. 7 is a rear, partial top side elevational view of an alternate embodiment of the present invention.

In accordance to one embodiment shown in FIG. 7, alternatively to bores 159, the planar plate 53 may comprise a plurality of perpendicularly-oriented apertures 259 defined perpendicularly therethrough, wherein each the plurality of apertures 259 for respectively receiving a threaded insert 190 of the plurality of threaded inserts 190, the threaded inserts 190 being seated and securably affixed in the apertures 259.

Figure 4:
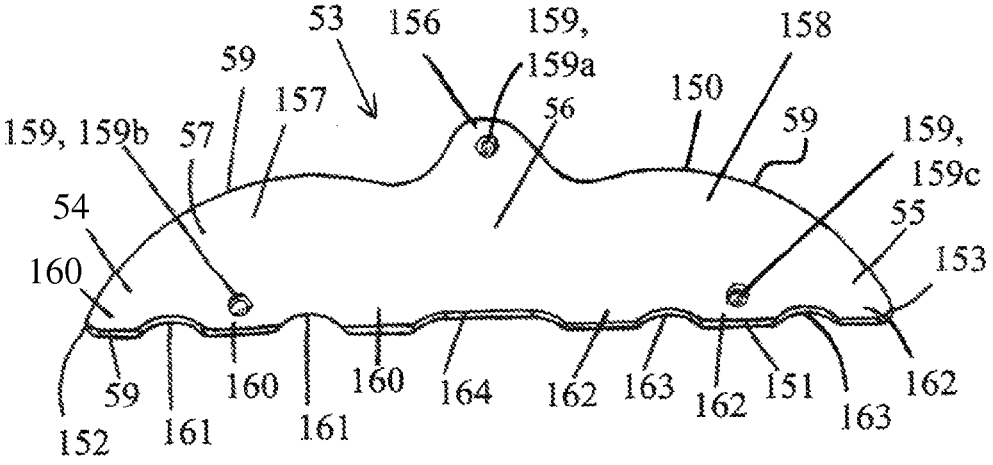
FIG. 4 is a front perspective view of another plate of the apparatus for cleaning baseboards, in accordance to one embodiment of the present invention.

In reference to FIG. 4, along the front surface 57 of planar plate 53, the plurality of perpendicularly-oriented bores 159 comprises a first bore 159*a* formed in the ear 156 of planar plate 53, a second bore 159*b* formed in the anterior region 54, adjacent the bottom surface 151, and a third bore 159*c* formed in the posterior region 55, adjacent the bottom surface 151.

Figure 5:
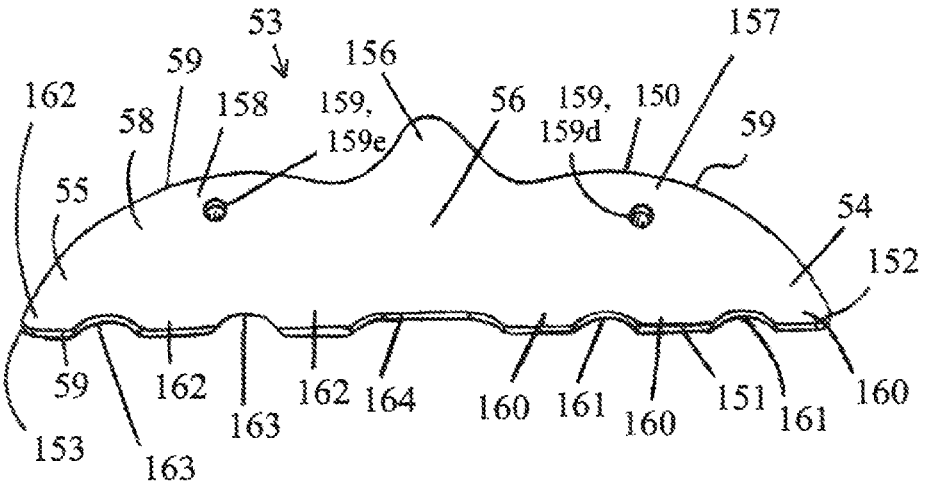
FIG. 5 is a rear perspective view of the plate of FIG. 4.

In reference to FIG. 5, along the rear surface 58 of planar plate 53, the plurality of perpendicularly-oriented bores 159 comprises a fourth bore 159*d* formed in the first arcuate section 157 of planar plate 53, proximate the top surface 150, and a fifth bore 159*e* formed in the second arcuate section 158 of planar plate 53, proximate the top surface 150.

Figure 6:
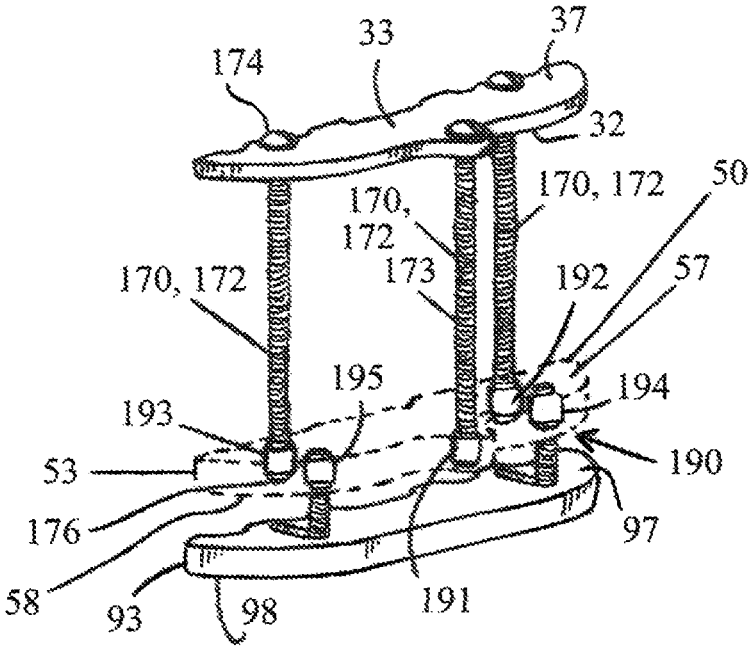
FIG. 6 is a left, partial top front perspective view of the upper and lower sections of a cleaning head, in accordance to one embodiment of the present invention.

Regarding FIG. 6, the plurality of threaded inserts 190 comprises a first threaded insert 191, a second threaded insert 192, a third threaded insert 193, a fourth threaded insert 194, and a fifth threaded insert 195. The first threaded insert 191 is seated and securably affixed in first bore 159*a*, the second threaded insert 192 is seated and securably affixed in second bore 159*b*, the third threaded insert 193 is seated and securably affixed in third bore 159*c*, the fourth threaded insert 194 is seated and securably affixed in fourth bore 159*d*, and the fifth threaded insert 195 is seated and securably affixed in fifth bore 159*e*.

Figure 8:
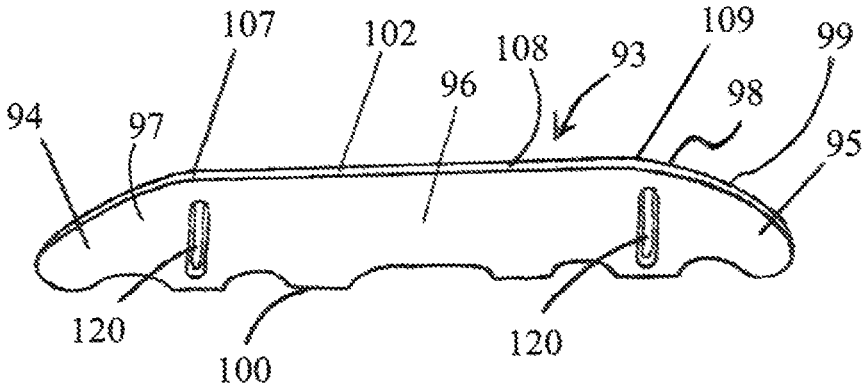
FIG. 8 is a front perspective view of a base plate of an apparatus for cleaning baseboards, in accordance to one embodiment of the present invention.
Figure 9:
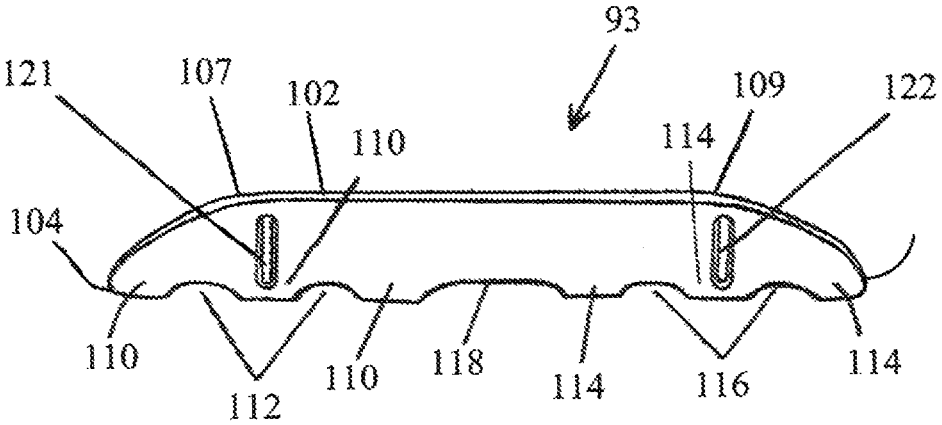
FIG. 9 illustrates another front perspective view of the base plate of the apparatus for cleaning baseboards, in accordance to one embodiment of the present invention.
Figure 10:
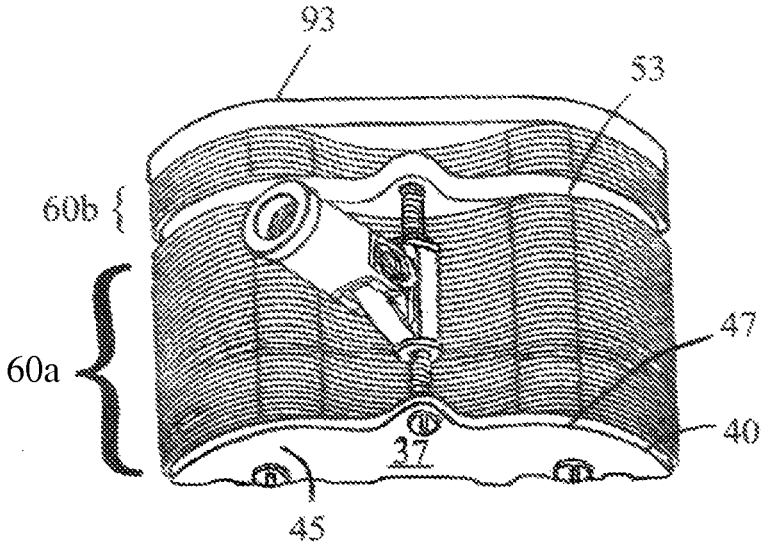
FIG. 10 is a front, top perspective view of a cleaning head with a handle coupling device, in accordance to one embodiment of the present invention.
Figure 11:
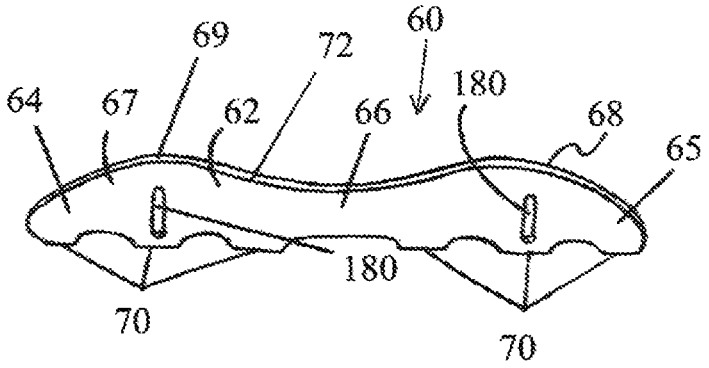
FIG. 11 is a front perspective view of a cleaning pad, in accordance to one embodiment of the present invention.
Figure 12:
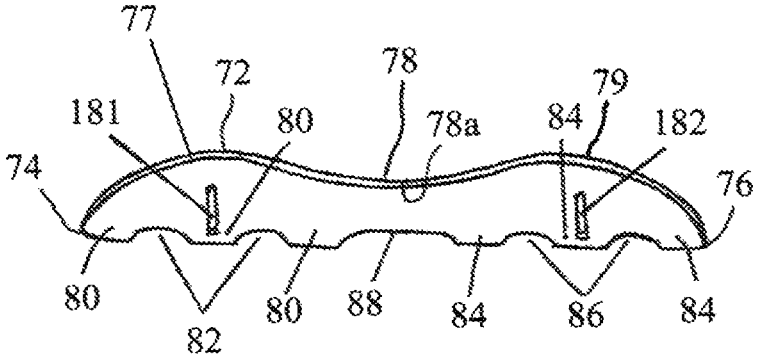
FIG. 12 illustrates another front perspective view of the cleaning pad, in accordance to one embodiment of the present invention.

Referring now to FIGS. 6-10, and more particularly to FIGS. 8 and 9, the lower section 90 comprises a base plate 93 comprising a planar configuration. The base plate 93 provides a number of structural, functional features which form important elements of the present invention. For example, the base plate 93 includes a means for preventing the bolts 172 from contacting the floor surface 8*a* during a baseboard cleaning operation, thereby protecting the floor surface 8*a* against damage, such as scratches, abrasions, and dents during said baseboard cleaning operation. It is envisioned the base plate 93 may be constructed of a rigid or semi-rigid material, or a lightweight rigid or semi-rigid material which may be selected from the group which includes, but is not limited to wood, plastic, thermoplastic, metal, and metallic-plastic composite. The base plate 93 may also be constructed of rigid, semi-rigid resilient foam material or cellular polymer material having elastomeric properties.

It is further envisioned base plate 93 may be constructed of a material comprising an elastomer compound, wherein the elastomer compound may comprise a thermoplastic elastomer, thermosetting elastomer, or a mixture thereof, or otherwise. Exemplary elastomers include, but are not limited to, natural rubber, styrenebutadiene rubber, polyisoprene, polyisobutylene, polybutadiene, isoprene-butadiene copolymer, neoprene, nitrile rubber, butyl rubber, polysulfide elastomer, acrylic elastomer, acrylonitrile elastomers, silicone rubber, polysiloxanes, polyester rubber, diisocyanate-linked condensation elastomer, EPDM (ethylene propylene diene rubbers), chlorosulphonated polyethylene, fluorinated hydrocarbons and the like.

The elastomeric compound construction material may further comprise a number of different polymers incorporated therein, for example, via copolymerization, blending, or otherwise. These different polymers which may be appropriately incorporated into the elastomeric compound construction material and may include, but are not limited to, halogenated polymers, polycarbonates, polyketones, urethanes, polyesters, silanes, sulfones, allyls, olefins, styrenes, acetates, ethylene vinyl acetates, acrylates, methacrylates, epoxies, silicones, phenolics, rubbers, polyphenylene oxides, terphthalates, or mixtures thereof. Other potential polymeric materials may include, without limitation, polyethylene, polypropylene, polystyrene, polyolefin, polyacrylate, poly(ethylene oxide), poly(ethyleneimine), polyester, polyurethane, polysiloxane, polyether, polyphosphazine, polyamide, polyimide, polyisobutylene, polyacrylonitrile, poly(vinyl chloride), poly(methylmethacrylate), poly(vinyl acetate), poly(vinylidene chloride), polytetrafluoroethylene, polyisoprene, polyacrylamide, polyacrylic acid, polymethacrylate, and polyacetals.

In accordance to one embodiment, the base plate 93 is constructed of a rigid or semi-rigid foam material comprised of a copolymer, wherein the copolymer comprises EVA (ethylene vinyl acetate).

The base plate 93 comprises an anterior region 94, a posterior region 95, and a central region 96 oriented therebetween. The base plate 93 includes a front surface 97 opposing a rear surface 98, and a continuous peripheral edge 99 integrally joining the front surface 97 and rear surface 98, the continuous peripheral edge 99 is oriented perpendicular to the front and rear surfaces 97 and 98. The continuous peripheral edge 99 defines a bottom surface 100 opposing a top surface 102.

The base plate 93 further includes a first outer bevel-sloped corner 104 and a second outer bevel-sloped corner 106. The first outer corner 104 is defined as the intersection of the top surface 102 and the bottom surface 100 about the anterior region 94. The second outer corner 106 is defined as the intersection of the top surface 102 and the bottom surface 100 about the posterior region 95.

The first outer corner 104 extends upward inclinationally towards the top surface 102 to an uppermost point 107, and the second outer corner 106 extends upward inclinationally towards the top surface 102 to an uppermost point 109. The first and second outer corners 104 and 106 are joined integrally at respective uppermost points 107 and 109 by an elongated horizontal cornice 108 of the top surface 102.

The bottom surface 100 of base plate 93 includes a first series of lateral, downwardly extending flanges 110, the flanges 110 being integrally interposed by at least two upwardly oriented, spaced semi-circular recesses 112. The bottom surface 100 further includes a second series of lateral, downwardly extending flanges 114, the second series of flanges 114 being integrally interposed by at least two upwardly oriented, spaced semi-circular recesses 116. The first and second series of lateral, downwardly extending flanges 110 and 114 are integrally joined by a laterally-elongated recess 118 interposed therebetween.

The base plate 93 further comprises a pair of vertically-oriented, prolate voids 120 defined therethrough, the prolate voids 120 being spatially distal to one another. The prolate voids 120 are adapted to receive the fastener 170 therethrough (fastener 170 shown herein as a threaded bolt 172). The pair of prolate voids 120 comprises a first prolate void 121 positioned proximate the first arcuate section 107, and a second prolate void 122 is provided proximate the second arcuate section 109. The prolate voids 120 allow for vertical translation by the pads 60 about the bolt 172.

In accordance to one embodiment, the pair of prolate voids 120 may each further comprise a recessed mouth section 124 formed about the perimeter thereof on the rear surface 98 of each prolate void 120, the recessed mouth section 124 forming a longitudinal guide shelf against which the lower surface of bolt head 174 engages. The mouth section 124 defines a depth measure suitable to allow the upper surface of bolt head 174 to lie below the horizontal plane formed by the rear surface 98 of base plate 93 when the present invention (and particularly the first and second set of pads 60*a* and 60*b*) is fully assembled and ready for use. Significantly, because the bolt heads 174 of base plate 93 are threadedly positioned below the plane formed by the rear surface 98 of base plate 93, the bolt 172 is prevented from contacting the floor surface 8*a* during a baseboard cleaning operation or event, thereby protecting the floor surface 8*a* against damage, such as scratches, abrasions, and dents during said baseboard cleaning operation.

In reference to FIGS. 6, and 10-12, according to one embodiment, the plurality of pads 60 comprises a first set of pads 60*a* and a second set of pads 60*b*. Each pad 60 of the first and second set of pads 60*a* and 60*b* comprises a planar body 62, the body 62 comprising an anterior region 64, a posterior region 65, and a central region 66 oriented therebetween. The planar body 62 includes a front surface 67 opposing a rear surface 68, and a continuous peripheral edge 69 integrally joining the front surface 67 and rear surface 68, the continuous peripheral edge 69 is oriented perpendicular to the front and rear surfaces 67 and 68. The continuous peripheral edge 69 defines a baseboard contact surface 70, or bottom surface 70, opposing a top surface 72.

The planar body 62 further includes a first outer corner 74 and a second outer corner 76. The first outer corner 74 is defined as the intersection of the top surface 72 and the baseboard contact surface 70 about the anterior region 64. The second outer corner 76 is defined as the intersection of the top surface 72 and the baseboard contact surface 70 about the posterior region 65.

Each pad 60 comprises a shape defining the continuous peripheral edge 69 extending upward from the first outer corner 74 into a first arcuate section 77, the first arcuate section 77 terminating in an elongated concave section 78, the elongated concave section defines a nadir 78*a*. The elongated concave section 78 extends from the nadir 78*a* upwardly into a second arcuate section 79, the second arcuate section 79 terminating at the second outer corner 76.

The shape and configuration defined by the baseboard contact surface 70 imparts unanticipated and nonobvious functional utility to the present invention. The baseboard contact surface 70 includes a first series of lateral, downwardly extending flanges 80, the flanges 80 being integrally interposed by at least two upwardly oriented, spaced semi-circular recesses 82. The baseboard contact surface 70 further includes a second series of lateral, downwardly extending flanges 84, the second series of flanges 84 being integrally interposed by at least two upwardly oriented, spaced semi-circular recesses 86. The first and second series of lateral, downwardly extending flanges 80 and 84 are integrally joined by a laterally-elongated recess 88 interposed therebetween. The upwardly oriented, spaced semi-circular recesses 82 and 86 interposing the first and second series of lateral, downwardly extending flanges 80 and 84, respectively, and the laterally-elongated recess 88 reduce frictional drag during a cleaning operation. For purposes of this disclosure, the term "drag" is intended to mean to move across a surface.

The planar body 62 of each the plurality of pads 60 further comprises a pair of vertically-oriented, prolate voids 180 defined therethrough, the prolate voids 180 being spatially distal to one another. The prolate voids 180 are adapted to receive the fastener 170 therethrough (shown herein as a threaded bolt 172). A first prolate void 181 is provided proximate the first arcuate section 77, and a second prolate void 182 is provided proximate the second arcuate section 79. The prolate voids 180 allow for vertical translation by the pads about the bolt 172 (functional advantages thereof to be described later in greater detail).

The first set of pads 60*a* is detachably secured in stacked fashion and mirrored alignment between the planar plate 33 of upper support 32 and the planar plate 53 of lower support 50 by inserting the lower end 176 of threaded bolt 172 through the second hole 146*b* of the anterior region 34 of front surface 37 planar plate 33, and through each first prolate void 181 of each the first set of pads 60*a*, and threadedly engaging the lower end 176 of bolt 172 with second threaded insert 192 of planar plate 53 of lower support 50. Next, the lower end 176 of another threaded bolt 172 is inserted through the third hole 146*c* of the anterior region 34 of front surface 37 planar plate 33, and through each second prolate void 182 of each the first set of pads 60*a*, and threadedly engaging the lower end 176 of bolt 172 with third threaded insert 193 of planar plate 53 of lower support 50.

The second set of pads 60*b* is detachably secured in stacked fashion and mirrored alignment between the planar plate of lower support 50 and the base plate 93 of the lower section 90. From the rear surface 98 side of base plate 93, the lower end 176 of threaded bolt 172 is inserted through the first prolate void 121 of base plate 93, and through each first prolate void 181 of each the second set of pads 60*b*, and threadedly engages the fourth threaded insert 194 of planar plate 53 of lower support 50. Next, from the rear surface 98 side of base plate 93, the lower end 176 of another threaded bolt 172 is inserted through the second prolate void 122 of the base plate 93, and through each second prolate void 182 of each the second set of pads 60*b*, and threadedly engages the fifth threaded insert 195 of planar plate 53 of lower support 50.

In accordance to one embodiment, the plurality of pads are uniformly shaped, configured, and designed, or are otherwise identical to one another regarding shape, configuration, and design thereof. In addition, the plurality of pads 60 preferably comprises homogeneous compositions, or the pads 60 are otherwise constructed of the same construction material.

In accordance to one embodiment, each of the plurality of pads 60 is constructed of a resilient or returnably-resilient cushion material, wherein the cushion material is more specifically defined as a foam material or a cellular polymer material. The foam or cellular polymer material may be constructed from a material selected from the group which includes, but is not limited to polyurethane, and polyisocyanurate. The foam or cellular polymer material may also be constructed from other suitable polymeric materials selected from the group which includes, but is not limited to polyolefins, polyvinylchloride, alkenyl aromatic polymers, cellulosic polymers, polycarbonates, polyetherimides, polyamides, polyesters, polyvinylidene chloride, polymethylmethacrylate, polyurethanes, polyisocyanurates, phenolics, copolymers and terpolymers of the foregoing, polymer blends, rubber modified polymers, and the like. Suitable polyolefins include polyethylene and polypropylene.

In accordance to one embodiment, each of the plurality of pads 60 is constructed of a rigid or semi-rigid, returnably-resilient foam material comprised of a copolymer, wherein the copolymer comprises EVA (ethylene vinyl acetate).

The material selected for constructing pads 60 is further defined as including durable, reusable, non-abrasive and absorbent materials, or the pad 60 construction material otherwise has or exhibits properties characterized as highly durable, reusable, non-abrasive, and absorbent.

The foam pads 60 each comprising a thickness measuring approximately between 0.0625" to 0.500", preferably between 0.094" to 0.250", and most preferably 0.125".

The plurality of pads 60 are constructed of a returnably-resilient material allowing the pads 60 to adapt and flexibly conform to the outer surface shape and contour of baseboards 5, including shoe molding 5*a* any other floor molding and floor trimming as the baseboard contact surface 70 of the pads 60 of cleaning head 20 slidably navigates, as well as reciprocates, along baseboards 5. In addition to adapting and flexibly conforming to the outer surface shape and contour of baseboards 5 as the baseboard contact surface 70 of the pads 60 of cleaning head 20 slidably navigates along the outer surface of baseboards, the plurality of pads 60 in a concurrent fashion vertically translate about the bolt 172 via the pair of prolate voids 180 of each pad 60 to a vertical distance (raising and lowering) equal to and consistent with elevational changes regarding the surface shape and contour afforded by baseboards 5. Thus, the pads 60 independently vertically translate relative to the outer surface of baseboards 5. Such pad 60 movement function can also be described as the pads 60 are vertically displaced independently relative to the outer surface of baseboards 5 as the pads 60 slidably navigate along the outer surface of baseboards 5.

Figure 13:
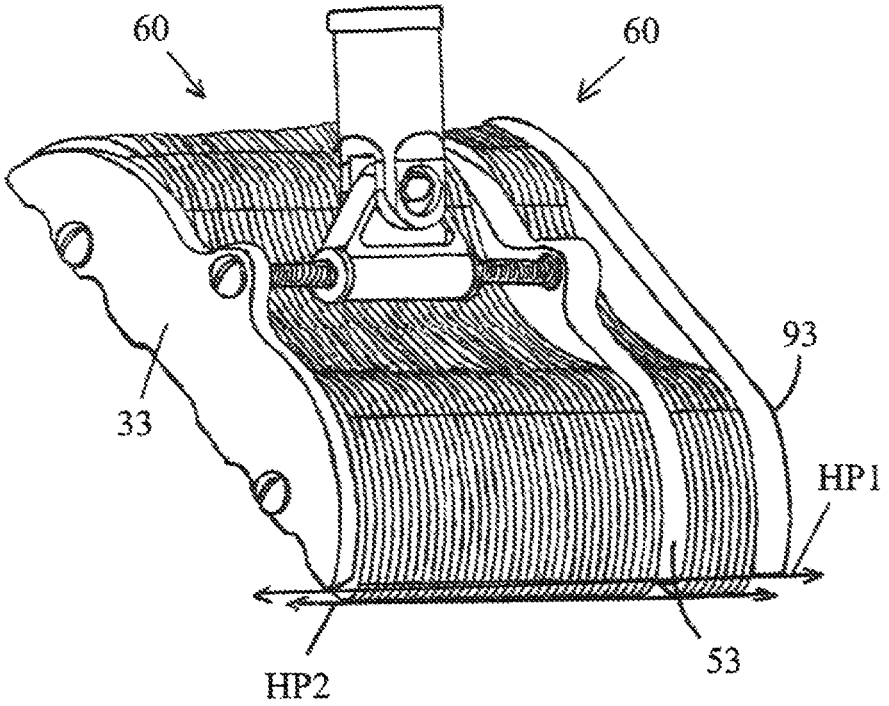
FIG. 13 is a left, partial top front perspective view of a cleaning head, in accordance to one embodiment of the present invention.
Figure 14:
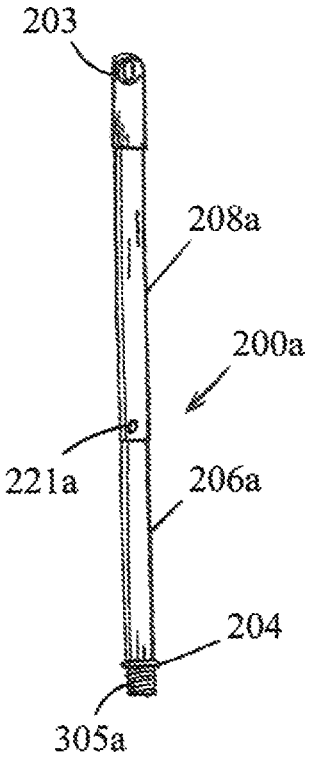
FIG. 14 is a side elevational view of handle, in accordance to one embodiment of the present invention.

Further, in order to prevent damage to baseboards 5 (e.g., scratches, abrasions, and dents) during a baseboard cleaning operation, once the apparatus 10 has been assembled and ready for operation, the plurality of pads 60 of the cleaning head 20 is sized and configured so as to be positioned such that the baseboard contact surface 70 thereof is positioned at a horizontal plane HP2 being lower than a horizontal plane HP1 at which the bottom surfaces 41, 151, and 100 of plates 33, 53, and 93, respectively, are positioned, as shown in FIG. 13. Such alignment ensures contact by only the pads 60 with baseboards 5 and shoe molding 5*a*.

Referring now more particularly to FIGS. 1, 7, 13-16, and 18-21, in accordance to one embodiment, the handle 200 is coupled to the cleaning head 20 via a bi-directional pivot assembly 210. In accordance to one embodiment, the handle 200 may comprise a single elongated cylinder 202 or member comprising an upper end 203 and a lower end 204. The lower end 204 of handle 200, 200*a* comprises a stem 205, 205*a*. According to one embodiment the stem 205, 205*a* includes a plurality of threads 305, 305*a*.

In accordance to another embodiment, the handle 200*a* is telescopically adjustable so as to allow for a plurality of selectively-desired, longitudinal setting positions thereof. The telescopically adjustable handle 200*a* comprises a first linearly elongated cylinder 206 telescopically engageable with a second linearly elongated cylinder 208. The elongated cylinders 206 and 208 are adjustably lockable at a desired longitudinal position or setting via a conventional locking assembly 220.

In accordance to one embodiment, the locking assembly 220 comprises a spring-biased pin assembly 222 disposed about the second cylinder 208. The second cylinder 208 includes a hole 209 defined axially through both sides thereof, and the first cylinder 206 includes a series of holes 207 defined through both sides thereof in corresponding relation so that a pin 224 of pin assembly 222 may be utilized to secure the second cylinder 208 and first cylinder 206 at a desired longitudinal position. More specifically, the pin 224 extends through hole 209 of second cylinder 208 and engages a selected hole 207 defined through both sides of first cylinder 206 and exits hole 209 of opposing side of second cylinder 208. Thus, the holes 207 of first cylinder 206 cooperate with the pin 224 of pin assembly 222 that permits the pin 224 to extend initially through the hole 209 of second cylinder 208, through a selected hole 207 of first cylinder 206, and through hole 209 of opposing side of second cylinder 208, thereby securing the first and second cylinders 206 and 208 to one another.

In a resting position, pin 224 is urged by a spring (not shown) inwardly towards the cylinder receiving cavity 209*a* of second cylinder 208. In order to adjustably secure the first and second cylinders 206 and 208 of handle 200*a* to a selectively-desired longitudinal setting, the pin 224 is retracted or pulled axially until pin 224 is effectively removed from the first cylinder 206, and pin 224 is held in such retracted position, while the first and second cylinders 206 and 208 are telescopically adjusted relative to one another to a desired handle 200*a* length. Upon obtaining desired handle 200*a* length or longitudinal setting, operator releases pin 224 to allow pin 224 to engage one of the holes 207 of first cylinder 122.

Figure 17:
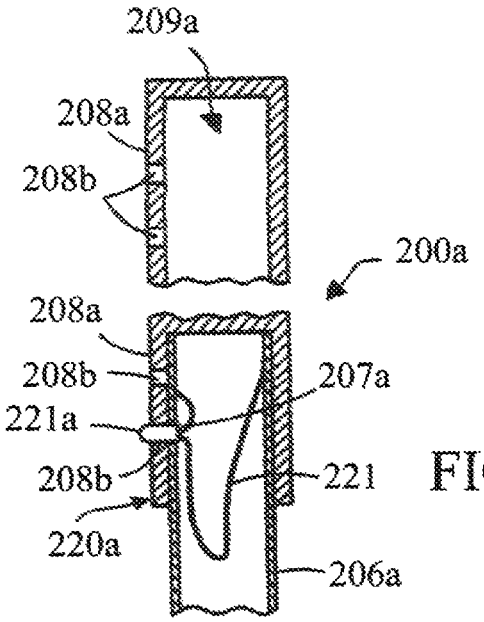
FIG. 17 is a partial, longitudinal sectional view of a telescopic handle disposed with a locking assembly, in accordance to another embodiment of the present invention.
Figure 15:
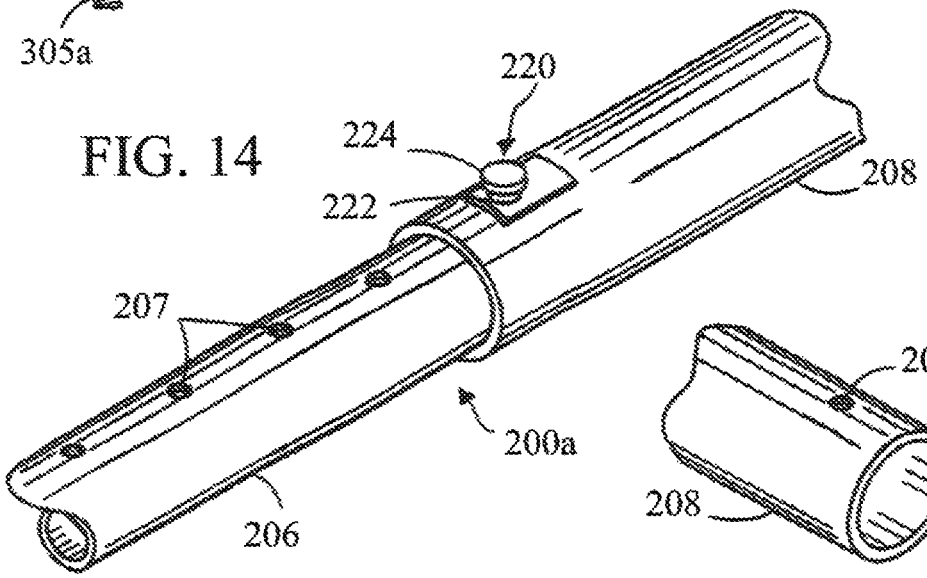
FIG. 15 is a partial perspective view of a telescopic handle disposed with a locking assembly, in accordance to one embodiment of the present invention.
Figure 16:
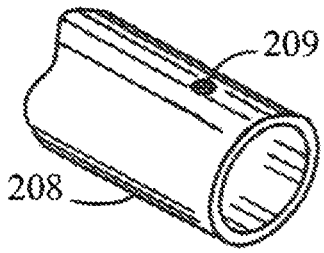
FIG. 16 is a partial perspective view of the outer cylinder of the telescopic handle of FIG. 15 illustrating the hole defined axially through both sides of the outer cylinder.
Figure 18:
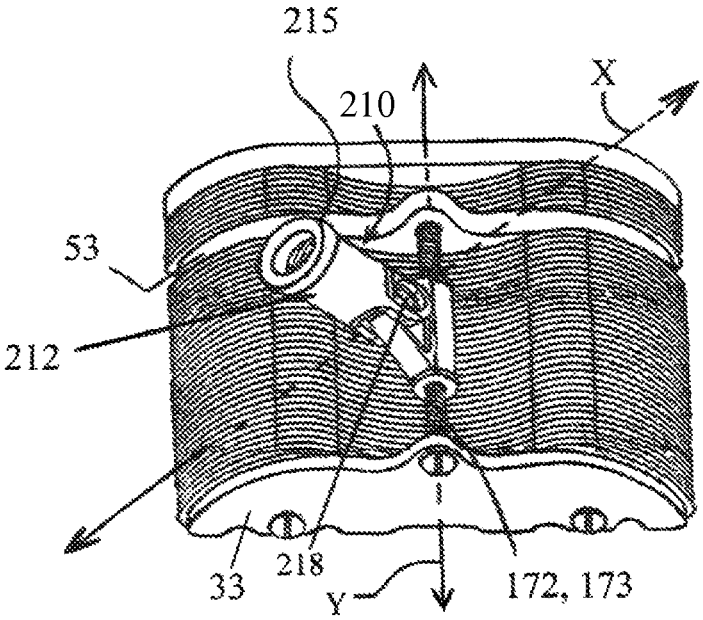
FIG. 18 is a front, top perspective view of a cleaning head illustrating a pivot assembly pivotally secured thereto, in accordance to one embodiment of the present invention.
Figure 19:
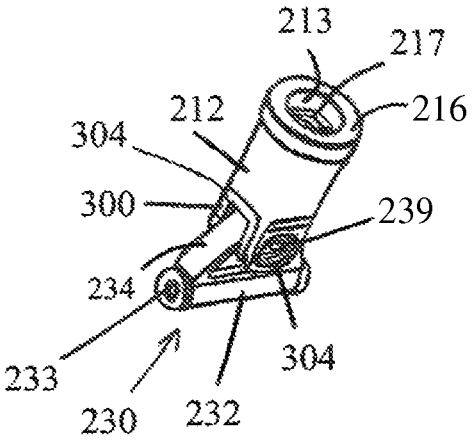
FIG. 19 is a partial front, left side perspective view of a pivot assembly, in accordance to one embodiment of the present invention.
Figure 20:
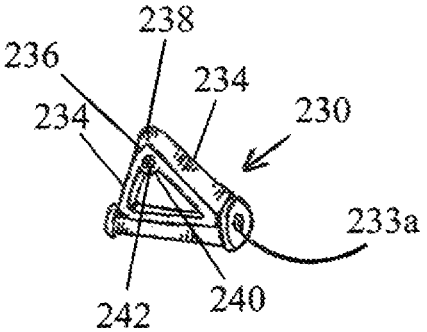
FIG. 20 is a partial rear, left side perspective view of a tongue element of a pivot assembly, in accordance to one embodiment of the present invention.
Figure 21:
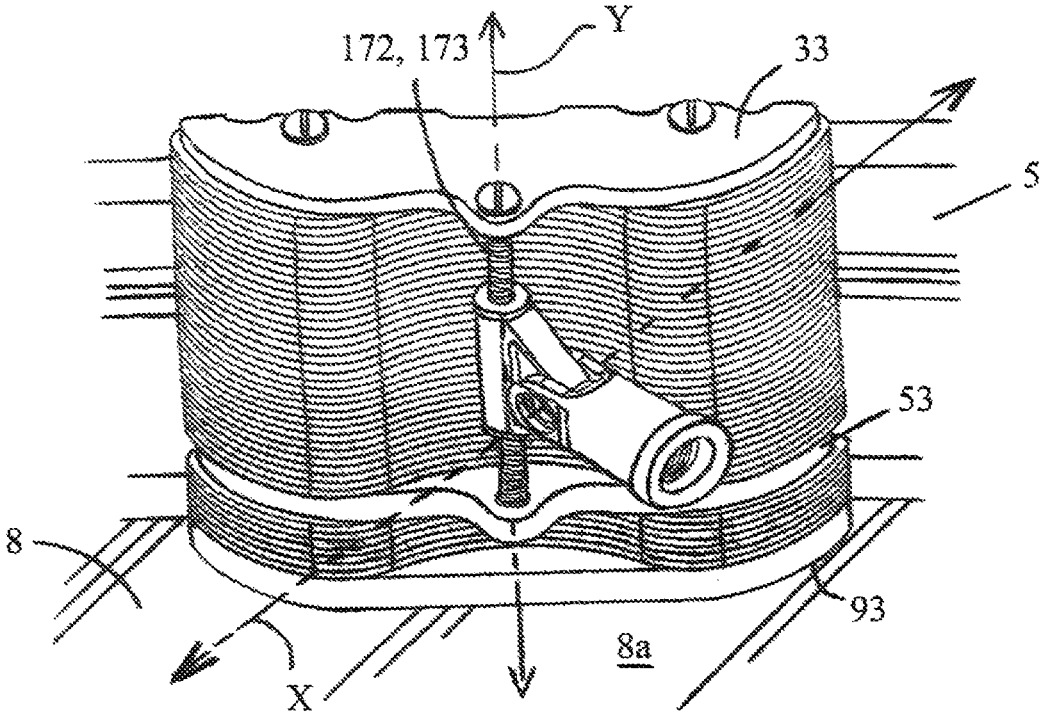
FIG. 21 is a top, front perspective view of a cleaning head showing a pivot assembly coupled thereto and the planes about which the pivot assembly pivots, in accordance to one embodiment of the present invention.

In reference to FIG. 17, in accordance to another locking assembly 220*a* embodiment, locking assembly 220*a* comprises a generally conical-shaped spring member 221 mounted to an inner surface of first cylinder 206*a*, the spring member 221 includes a button 221*a* protruding integrally outward therefrom and through an aperture 207*a* defined axially through a sidewall of first cylinder 206*a*. In further accordance to this particular embodiment, the second cylinder 208*a* includes a series of apertures 208*b* defined through at least one sidewall thereof in corresponding relation so as to allow the button 221*a* to extend through aperture 207*a* of first cylinder 206*a* and to engage and exit a selected aperture 208*b* of second cylinder 208*a*, thereby removably securing the second cylinder 208*a* and first cylinder 206*a* at a desired longitudinal position. A distal segment of spring member 221 extends and engages the inner surface of first cylinder 206*a* to bias the button 221*a* into a selected aperture 125*a* of outer cylinder 124*a*.

The locking assembly 220 may alternatively be a spring-biased detent assembly or other locking mechanism suitable for detachably securing the cylinders 206, 206*a* and 208, 208*a* about a selectively-desired longitudinal position.

Referring now more specifically to FIGS. 1, 6, 7, 14, and 18-21, as previously described, the handle 200, 200*a* is coupled to the cleaning head 20 via the bi-directional pivot assembly 210. In accordance to one embodiment, the pivot assembly 210 comprises a socket 212 having an open top 214, a bottom 218, and an axial through passage 219 for receiving the lower end 204 of handle 200, 200*a*. The open top 214 defines a mouth portion 215 defining an upper surface 216. The mouth portion 215 is in open fluid communication with axial through passage 219. The socket 212 includes an interior sidewall 213 comprising a plurality of threads 217. The bottom 218 bifurcates into a pair of curved lobes 300, the curved lobes 300 being appositionally positioned and each having a hole 304 defined therethrough.

The pivot assembly 210 further comprises a triangular-shaped tongue 230 comprising an elongated, cylindrical base 232 having a pair of arms 234 extending integrally from opposed ends, respectively, of the base 232 and forming an anticline 236 having an apex 238. The base 232 comprises a bore 233 extending axially therethrough, the bore 233 includes a plurality of complementary threads 233*a* for threadedly engaging a threaded fastener 170. A downwardly-protruding flange 240 is positioned between the pair of arms 234, below the apex 238. An aperture 242 is defined centrally through the flange 240, the aperture 242 for receiving a coupling pin 239 or other fastener therethrough. The flange 240 may be molded integral to the triangular-shaped tongue 230, and is therefore envisioned to be formed during the molding process. The tongue 230 is inserted into the socket 212 and pivotally coupled thereto via the coupling pin 239 or other fastener being suitable to facilitate secured pivotal attachment of tongue 230 to socket 212. More specifically, the apex 238 of the tongue 230 is inserted through the bottom 218 of socket 212 between the curved lobes 300. The aperture 242 of tongue 230 is axially aligned with the holes 304 of the curved lobes 300 of socket 212, and a coupling pin 239 is inserted through one of the holes 304 of one of the curved lobes 300, through the aperture 242 of tongue 230 and through the other hole 304 of the other curved lobe 300, thereby pivotally coupling the tongue 230 to the socket 212.

The bi-directional pivot assembly 210 is pivotally coupled to the cleaning head 20 of the apparatus 10 via a fastener 170, the fastener 170 illustrated therein as a threaded bolt 172, wherein threaded bolt 172 being further defined as an ear receiving bolt 173. The pivot assembly 210 is pivotally coupled to the cleaning head 20 by inserting the lower end 176 of threaded bolt 172 through the first hole 146*a* of the front surface 37 planar plate 33, threadedly engaging the lower end 176 of bolt 172 with the threaded bore 233 of tongue 230, and threadedly engaging the lower end 176 of bolt 172 with the first threaded insert 191 of the planar plate 53 of the lower support 50.

In accordance to one embodiment, the lower end 204 of handle 200, 200*a* comprises a stem 205, 205*a* which includes a plurality of complementary threads for threadedly engaging the plurality of threads 217 of the interior sidewall 213 of socket 212, thereby detachably securing the handle 200, 200*a* to the bi-directional pivot assembly 210, and hence to the cleaning head 20. Alternatively, the handle 200, 200*a* may be detachably affixed to the pivot assembly 210 via a suitable fastener, e.g., one or more screws, a snap-fit arrangement, mechanical interference-type fit, or other suitable attaching means. Thus, such other fastening devices and mechanisms are contemplated and within the scope and spirit of the present invention.

The pivot assembly 210 imparts important, unanticipated and nonobvious functional utility to the present invention as described in detail hereinbelow.

In particular reference to FIGS. 1, 14 and 18-21, the pivot assembly 210 allows the handle 200, 200*a* to be pivotally urged bi-directionally. For purposes of this disclosure, "bi-directionally" is intended to mean pivoting in two different planes. More specifically, the handle 200, 200*a*, via the pivot assembly 210, is pivotally adjustable about horizontal axis X, defined as the coupling pin 239, and handle 200, 200*a* is pivotally adjustable about longitudinal axis Y, defined as the ear receiving bolt 173.

The cleaning head 20 and bi-directionally adjustable handle 200, 200*a* provide unanticipated and nonobvious combination of features, advantages, and utility distinguished from the products, devices, apparatuses, inventions and methods preexisting in the art. Further, the cleaning head 20 and bi-directionally adjustable handle 200, 200*a* of the apparatus 10 allow the present invention to provide the optimal baseboard cleaning device.

Figure 22:
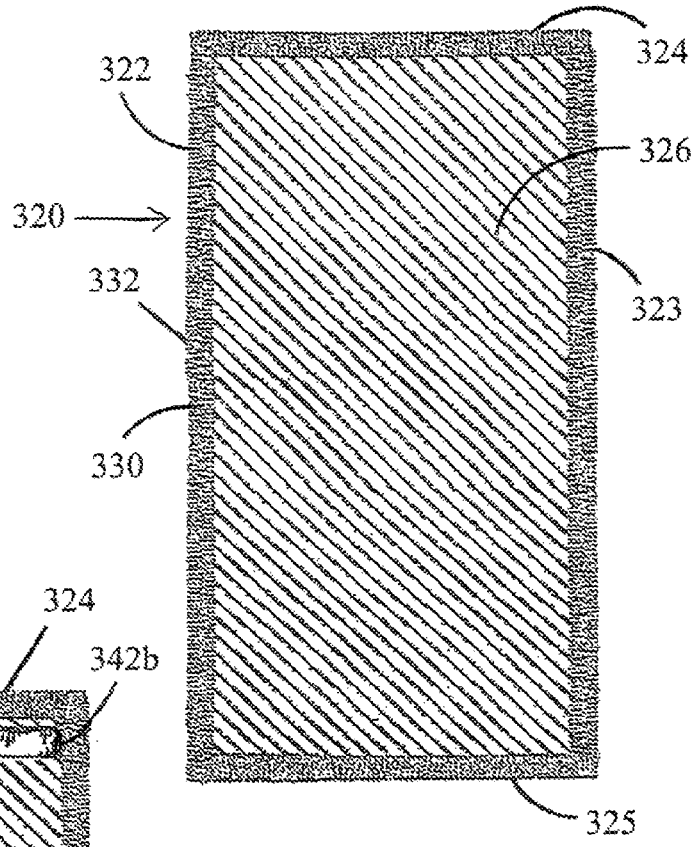
FIG. 22 is a top plan view of a supplemental segment, illustrated herein as a microfiber cloth, in accordance to one embodiment of the present invention.
Figure 23:
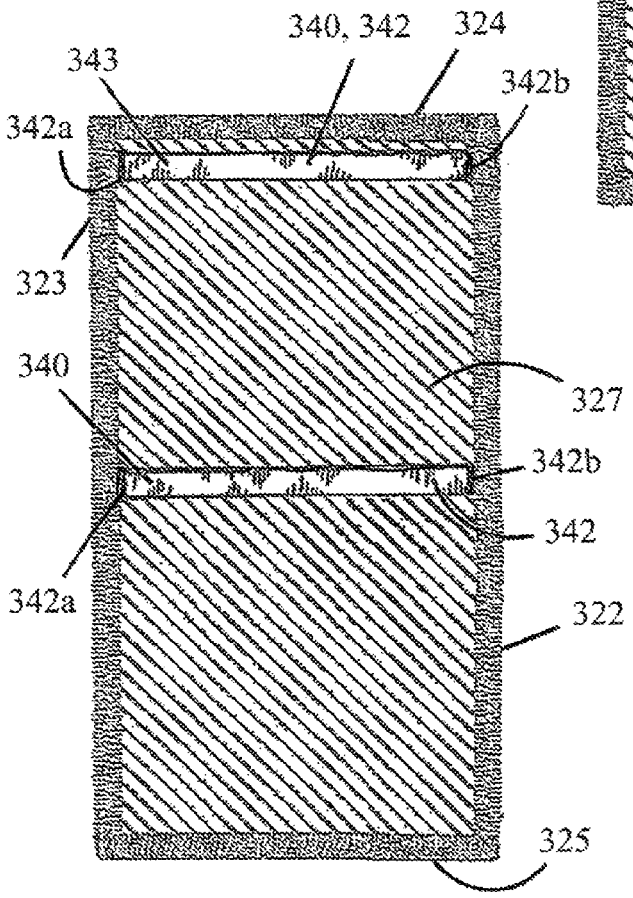
FIG. 23 is a bottom plan view of the supplemental segment of FIG. 22.
Figure 24:
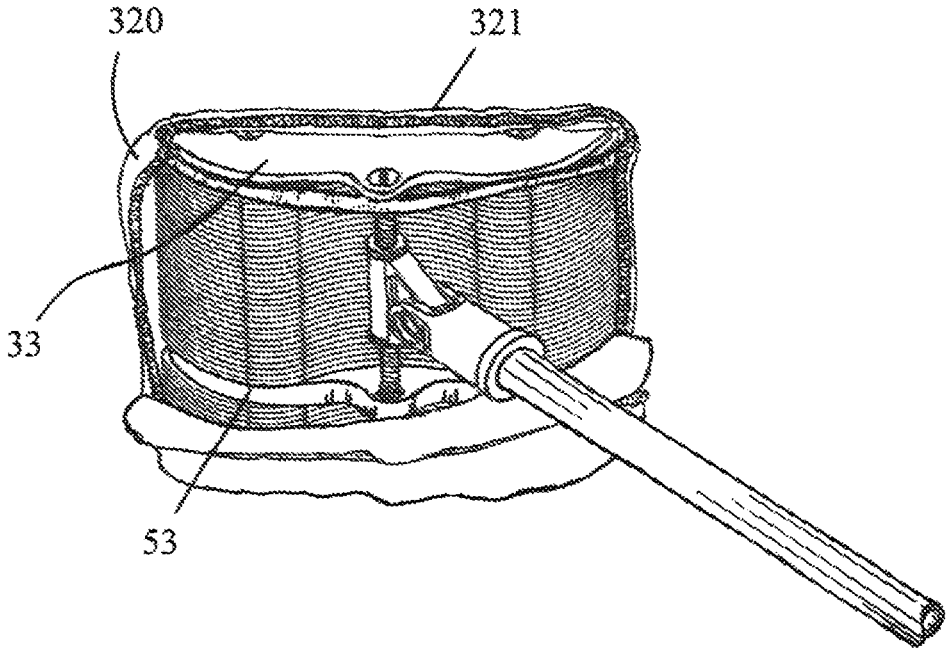
FIG. 24 is a partial top perspective view of the apparatus for cleaning baseboards shown with a microfiber cloth removably attached thereto, in accordance to one embodiment of the present invention.

Finally, in reference to FIGS. 22-24, a supplemental segment 320 is disclosed for removable attachment to the cleaning head 20. The supplemental segment 320 may be constructed of materials which include, but are not limited to, natural and synthetic textiles (e.g., cotton, wool, polyester, and fleece). Preferably however, supplemental segment 320 is constructed of soft, non-abrasive, absorbent materials that are durable and reusable, such as microfiber. As used herein, the term "microfiber" is intended to be broad, including ultra-fine manufactured fibers having a weight of less than approximately 1.0 denier. Cloth-like fabrics made from microfiber fibers have a flexible, gentle drape. Currently, microfiber fabrics are constructed from acrylic, nylon, polyester, rayon, silk, and combinations thereof; but the term as used herein is not limited to these materials.

In accordance to one embodiment, the supplemental segment 320 comprises a microfiber cloth 321 having a generally rectangular shape having an upper surface 326 opposing a lower surface 327. While the segment 320 is described and illustrated as comprising a generally rectangular shape, other geometric shapes and configurations are envisioned, and are therefore within the spirit and scope of the present invention.

Supplemental segment 320 further comprises a first side edge 322 parallel to a second side edge 323, and both being perpendicular to a first end edge 324 parallel to a second end edge 325. The supplemental segment 320 includes a reinforced outer periphery 330 in the form of continuous stitching 332.

The supplemental segment 320 further comprises a means for removably attaching supplemental segment 320 to the cleaning head 20. In accordance to one embodiment, the attachment means 340 comprises a plurality of elastomeric bands 342 or strips affixed, as by stitching, to the lower surface 327 (as best illustrated in FIG. 23) or upper surface of 326. In accordance to one embodiment, the elastomeric bands 342 are attached about opposing respective ends 342*a*, 342*b* thereof to the lower surface 327 of segment 320 in a spaced, parallel relationship. In this particular embodiment, the attachment points for each elastomeric band 342 may be coextensive with the outer periphery 330, as illustrated in FIG. 23. The opposing ends 342*a*, 342*b* of each elastic band 342 are affixed parallel to the first end edge 324 and second end edge 325, and perpendicular to first side edge 322 and second side edge 323.

In accordance to one embodiment, the supplemental segment 320 may be removably attached to the cleaning head 20 by engaging the bottom 20*b* of cleaning head 20 against the lower surface 327 of segment and looping the uppermost elastomeric band 343 over the planar plate 33 of upper support 32 and positioning the band 342 so it is looped over the ear receiving bolt 173, adjacent the rear surface 38 of planar plate 33. Next, the lower surface 327 of the remaining, free-hanging portion of segment 320 is engaged in a taut, snug manner over the rear surface 98 of base plate 93 and extended over the top surface 102 thereof, and any excess portion of segment 320 is thereafter extended over the top surface 72 of the plurality of pads 60 (shown in FIG. 24 as the second set of pads 60*b* of the plurality of pads 60). In the event the segment 320 still includes a length of free-hanging portion, such portion may be overlapped on itself. Finally, the next (or second) elastomeric band 342, positioned spatially below the uppermost elastomeric band 343, is looped over the upper surface 326 of the segment 320 (or over the overlapped portion of segment 320) and over the top surface 72 of the second set of pads 60*b* of the plurality of pads 60, and thereby removably attaching the supplemental segment 320 to the cleaning head 20.

The attachment means may comprise other suitable fastening devices or complementary type or matching connector devices and systems which include, but are not limited to, hook-and-loop fastening system (Velcro®), snap-fit mechanisms, mechanical interference or frictional fit connection systems, adhesive strips with releasable liners, and combinations thereof.

It is envisioned that the various embodiments, as separately disclosed, are interchangeable in various aspects, so that elements of one embodiment may be incorporated into one or more of the other embodiments, and that specific positioning of individual elements may necessitate other arrangements not specifically disclosed to accommodate performance requirements or spatial considerations.

It is to be understood that the embodiments and claims are not limited in its application to the details of construction and arrangement of the components set forth in the description and illustrated in the drawings. Rather, the description and the drawings provide examples of the embodiments envisioned, but the claims are limited to the specific embodiments. The embodiments and claims disclosed herein are further capable of other embodiments and of being practiced and carried out in various ways. Also, it is to be understood that the phraseology and terminology employed herein are for the purposes of description and should not be regarded as limiting the claims.

Accordingly, those skilled in the art will appreciate that the conception upon which the application and claims are based may be readily utilized as a basis for the design of other structures, methods, and systems for carrying out the several purposes of the embodiments and claims presented in this application. It is important, therefore, that the claims be regarded as including such equivalent constructions.

Furthermore, the purpose of the foregoing Abstract is to enable the U.S. Patent and Trademark Office and the public generally, and especially including the practitioners in the art who are not familiar with patent and legal terms or phraseology, to determine quickly from a cursory inspection the nature and essence of the technical disclosure of the application. The Abstract is neither intended to define the claims of the application, nor is it intended to be limiting to the scope of the claims in any way. It is intended that the application is defined by the claims appended hereto.

What is claimed is:

1. An apparatus for cleaning baseboards, the apparatus comprising:

a cleaning head comprising:

an upper section and a lower section, the lower section comprising a base plate, the upper section comprising an upper support and a lower support, the upper support includes an upper planar plate, the lower support includes a lower planar plate, wherein the upper planar plate comprises:

an anterior region;

a posterior region;

a central region;

a front surface opposing a rear surface; and a continuous peripheral edge integrally joining the front surface and the rear surface, the continuous peripheral edge is oriented perpendicular to the front surface and the rear surface, and wherein the continuous peripheral edge includes a top surface opposing a bottom surface;

a coupling assembly;

a handle coupled to the cleaning head via the coupling assembly; and a plurality of pads, the plurality of pads comprises a first set of pads and a second set of pads.

2. The apparatus of claim 1, wherein the upper planar plate further comprises a first outer corner and a second outer corner, the first outer corner is formed by an intersection of the top surface and the bottom surface of the continuous peripheral edge about the anterior region, and wherein the second outer corner is formed by an intersection of the top surface and the bottom surface of the continuous peripheral edge about the posterior region.

3. The apparatus of claim of claim 1, wherein the lower planar plate comprises:

an anterior region;

a posterior region;

a central region;

a front surface opposing a rear surface; and a continuous peripheral edge integrally joining the front surface and the rear surface, the continuous peripheral edge is oriented perpendicular to the front surface and the rear surface, and wherein the continuous peripheral edge includes a top surface opposing a bottom surface.

4. The apparatus of claim of claim 3, wherein the lower planar plate further comprises a first outer corner and a second outer corner, the first outer corner is formed by an intersection of the top surface and the bottom surface of the continuous peripheral edge about the anterior region, and wherein the second outer corner is formed by an intersection of the top surface and the bottom surface of the continuous peripheral edge about the posterior region.

5. The apparatus of claim of claim 1, wherein the first set of pads is detachably secured in stacked fashion and mirrored alignment between the upper planar plate of the upper support and the lower planar plate of the lower support.

6. The apparatus of claim of claim 1, wherein the second set of pads is detachably secured in stacked fashion and mirrored alignment between the lower planar plate of the lower support and the base plate of the lower section.

7. An apparatus for cleaning floor and floor molding, the apparatus comprising:

a cleaning head, the cleaning head comprising an upper section and a lower section, the upper section comprising an upper support and a lower support;

a pivot assembly;

a handle coupled to the cleaning head via the pivot assembly; and a plurality of pads, wherein the lower section of the cleaning head comprises a base plate, wherein the base plate comprises:

an anterior region;

a posterior region;

a central region;

a front surface opposing a rear surface;

a continuous peripheral edge integrally joining the front surface and the rear surface, the continuous peripheral edge is oriented perpendicular to the front surface and the rear surface, the continuous peripheral edge includes a bottom surface opposing a top surface;

a first outer bevel-sloped corner; and a second outer bevel-sloped corner, the first outer corner is formed by an intersection of the top surface and the bottom surface of the continuous peripheral edge about the anterior region, the second outer corner is formed by an intersection of the top surface and the bottom surface of the continuous peripheral edge about the posterior region, and wherein the first outer corner extends upward inclinationally towards the top surface of the continuous peripheral edge to an uppermost point, and the second outer corner extends upward inclinationally towards the top surface of the continuous peripheral edge to an uppermost point, the first outer corner and the second outer corner are joined integrally at respective uppermost points by an elongated horizontal cornice of the top surface of the continuous peripheral edge.

8. The apparatus of claim 7, wherein the bottom surface of the continuous peripheral edge comprises:

a first series of lateral, downwardly extending flanges, the flanges being integrally interposed by at least two upwardly oriented, spaced semi-circular recesses; and a second series of lateral, downwardly extending flanges, the second series of flanges being integrally interposed by at least two upwardly oriented, spaced semi-circular recesses, and wherein the first and second series of lateral, downwardly extending flanges are integrally joined by a laterally-elongated recess interposed therebetween.

9. The apparatus of claim 7, wherein the upper support comprises an upper planar plate and the lower support comprises a lower planar plate.

10. The apparatus of claim 7, wherein the plurality of pads comprises a first set of pads and a second set of pads.

11. The apparatus of claim 7, wherein the pivot assembly is defined as a bi-directional pivot assembly, the handle being coupled to the bi-directional pivot assembly, the handle being pivotal bi-directionally.

12. The apparatus of claim 7, further comprising a supplemental segment removably attached to the cleaning head.

13. The apparatus of claim 12, further comprising a means for removably attaching the supplemental segment to the cleaning head.

14. The apparatus of claim 12, wherein the supplemental segment comprises a microfiber cloth.

* * * * *